US005941189A

United States Patent [19]

Johansson

[11] Patent Number: 5,941,189

[45] Date of Patent: Aug. 24, 1999

[54] WATERCRAFT

[76] Inventor: Nils Erik Johansson, 18 Pine Rd., Bedford Hills, N.Y. 10507

[21] Appl. No.: 08/373,069

[22] Filed: Jan. 13, 1995

[51] Int. Cl.[6] ..... B63B 1/00

[52] U.S. Cl. ..... 114/61.1; 114/61.12; 114/121

[58] Field of Search ..... 114/61, 274, 278, 114/279, 280, 281, 282, 283, 284, 292, 121, 122, 123, 125, 61.1, 61.12

[56] References Cited

U.S. PATENT DOCUMENTS

| | | | |
|---|---|---|---|
| 1,757,174 | 5/1930 | Douglas . | |
| 2,596,194 | 5/1952 | Anderson | 114/123 |
| 3,063,397 | 11/1962 | Boedericke . | |
| 3,340,595 | 3/1969 | Tulleners . | |
| 3,541,987 | 11/1970 | Barkley | 114/61 |
| 4,411,213 | 10/1983 | Laukien . | |
| 4,615,292 | 10/1986 | Laukien . | |
| 4,819,576 | 4/1989 | Shaw . | |
| 5,107,783 | 4/1992 | Magazzu | 114/61 |

OTHER PUBLICATIONS

H.N Abramson, "Structural Dynamics of Advanced Marine Vehicles", Marine Vehicles, pp. 344–346, 356, 357(date unknown).

E. Numata, "Predicting Hydrodynamic Behavior of Small–Water Plane Twin Hudd Ships", Marine Tech. pp.69–75 (Jan. '81).

Swath Ocean Advertisement. (Jan. 1993).

*Primary Examiner*—Stephen Avila
*Attorney, Agent, or Firm*—Tobias Lewenstein

[57] ABSTRACT

A watercraft has an abovewater passenger and/or cargo section as well as an underwater propulsion section. The two sections are connected by telescoping struts.

31 Claims, 3 Drawing Sheets

WATERCRAFT

FIELD OF THE INVENTION

The invention relates to watercraft.

BACKGROUND OF THE INVENTION

When a surface watercraft travels through the water, the hull creates a bow wave which increases in length as the speed of the watercraft increases. The length of the bow wave becomes equal to the length of the watercraft when the speed/length factor of the watercraft, that is, the factor relating speed to the square root of the water line length, reaches a generally accepted value of 1.34. To attain speeds in excess of those corresponding to a speed/length factor of 1.34, a watercraft must climb onto and over the bow wave.

The speed/length factor divides watercraft into three categories. At one extreme are displacement watercraft which have a maximum speed/length factor of about 1.34. This relatively low speed/length factor corresponds to a relatively low maximum speed. Attempting to increase this maximum speed by increasing the power output of the propulsion unit or units causes the stern to be pulled down and results in little, if any, gain in speed.

At the other extreme are planing watercraft which have a speed/length factor of about 2.5 to about 8. This type of watercraft can pull itself up onto the bow wave so that friction is reduced and speed can be increased. Top speed is nevertheless restricted by the maximum size of the propulsion unit or units which can be installed in the watercraft. Furthermore, planing watercraft are far less stable than displacement watercraft.

Between these extremes are semi-displacement watercraft having a speed/length factor of about 1.34 to about 2.5. Semi-displacement watercraft are designed in such a manner that they can begin to climb the bow wave. This makes it possible for watercraft of this type to achieve speeds which, although not as high as those of planing watercraft, exceed the maximum speed of displacement watercraft. Moreover, while the stability of semi-displacement watercraft is not as good as that of displacement watercraft, it is better than the stability of planing watercraft.

Aside from the speed restrictions imposed on surface watercraft by the fact that the hull is in contact with the surface of the water, such watercraft are greatly influenced by the condition of the water surface, e.g., by swells and waves. Additionally, surface watercraft must be designed to withstand the severe forces of the large waves generated during storms.

The drawbacks of surface watercraft are largely overcome by submersible watercraft. At depths greater than about three times the hull diameter, submersible watercraft are virtually unaffected by the conditions at the surface of the water. Furthermore, since submersible watercraft travel below the surface and do not generate a bow wave, they are free of the speed restrictions dictated by such wave. However, submersible watercraft generally are not acceptable for use as pleasure cruisers and are not well-adapted for carrying cargo. Moreover, submersible watercraft must meet the highly specialized criteria imposed by an underwater environment in which the watercraft must provide an atmosphere suitable for crew containment, comfort and life support.

Another class of watercraft attempts to combine the desirable features of surface watercraft with those of submersible watercraft. This hybrid watercraft consists of an abovewater deck which is supported by a pair of submerged, torpedo-like hulls equipped with engines. The hulls and the deck are connected to one another by vertical foils. Since neither the hulls nor the deck are in contact with the surface of the water, there is essentially no bow wave to restrict the speed of the hybrid watercraft. Moreover, inasmuch as the submerged hulls only serve for propulsion, the criteria imposed on the hulls are much less severe than those for submersible watercraft. The abovewater deck allows the hybrid watercraft to be used for pleasure. Although the hybrid watercraft offers significant advantages over surface watercraft and submersible watercraft, the abovewater deck is nevertheless exposed to the action of the waves. Especially during storms, this substantially affects passenger comfort as well as the performance of the hybrid watercraft. In addition, the hybrid watercraft must have the strength necessary to fixedly connect the hulls to the abovewater deck which rigidly spans the hulls above the surface of the water.

SUMMARY OF THE INVENTION

It is an object of the invention to provide a watercraft having an abovewater transport unit which, at least to a great degree, can remain free from the conditions existing at the surface of the water.

Another object of the invention is to provide a watercraft which, although equipped with an abovewater transport unit, can nevertheless operate much like a submersible watercraft.

The preceding objects, as well as others which will become apparent as the description proceeds, are achieved by the invention.

One aspect of the invention resides in a watercraft comprising an abovewater transport unit and an underwater unit for supporting the abovewater unit. The watercraft further comprises means for moving the units towards and away from one another.

The moving means allows the height of the abovewater unit over the surface of the water to be varied. This makes it possible to raise the abovewater unit as wave height increases or as other operating conditions warrant so that the abovewater unit can remain largely unaffected by the waves. Since the underwater unit is likewise able to avoid the action of the waves, the watercraft of the invention is able to operate in a manner approximating that of a submersible watercraft.

BRIEF DESCRIPTION OF THE DRAWINGS

Other features and advantages of the invention will be forthcoming from the following description of certain presently preferred embodiments when read in conjunction with the accompanying drawings.

DESCRIPTION OF PREFERRED EMBODIMENTS

Figure 1:
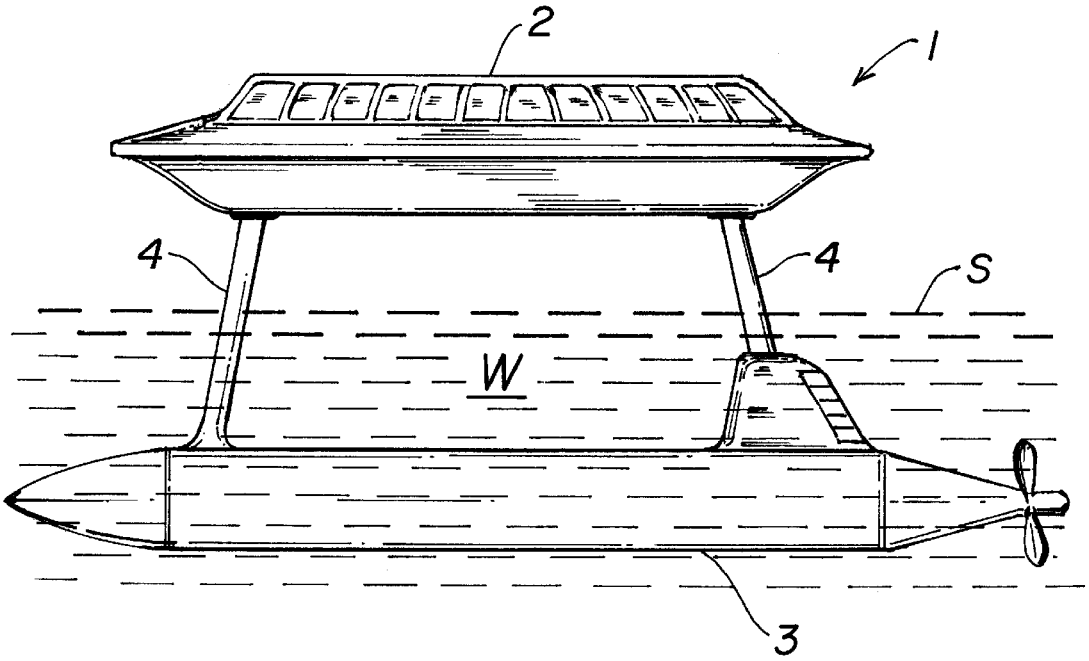
FIG. 1 is a side view of a watercraft according to the invention, the watercraft having an abovewater unit and an underwater unit connected to one another by struts.

The reference numeral 1 in FIG. 1 generally denotes a watercraft according to the invention. The watercraft 1 includes an abovewater unit 2 which travels above the surface S of a body of water W, an underwater unit 3 which travels below the surface S and a plurality of struts 4 which support the abovewater unit 2 on the underwater unit 3. The struts 4 can be rigidly connected to the units 2,3 or can be articulately connected to the units 2,3 by pivot joints or universal joints.

Figure 2:
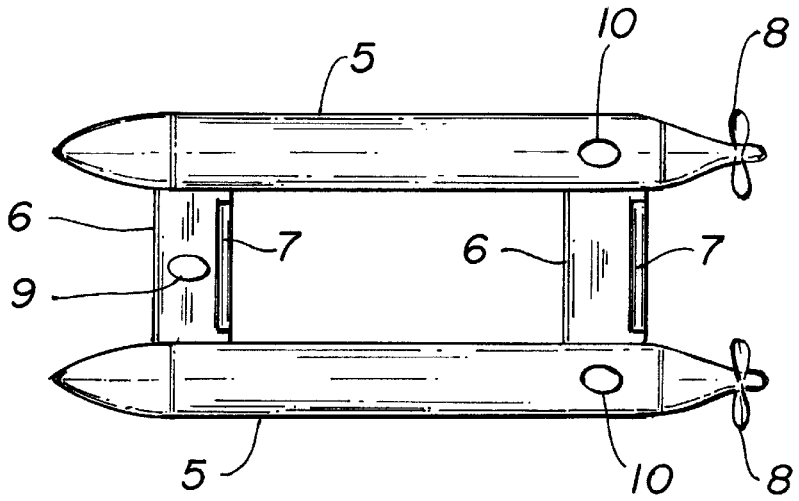
FIG. 2 is a plan view of the underwater unit of the watercraft of FIG. 1.

As shown in FIG. 2, the underwater unit 3 comprises a pair of spaced hulls 5 which resemble torpedoes. The hulls 5 are connected to one another by hollow, foil-shaped bracing elements 6. The bracing elements 6 are provided with movable horizontal control surfaces 7 which allow the underwater unit 3 to be moved up-and-down regardless of the buoyancy of the underwater unit 3. Each of the hulls 5 is provided with a propulsion element 8 which is here in the form of a propeller.

In the illustrated embodiment, the abovewater unit 2 is mounted on the underwater unit 3 by way of three struts 4. One of these struts 4 is articulated to a bracing element 6 at 9 while each of the remaining struts 4 is articulated to a respective hull 5 at 10.

Figure 3:
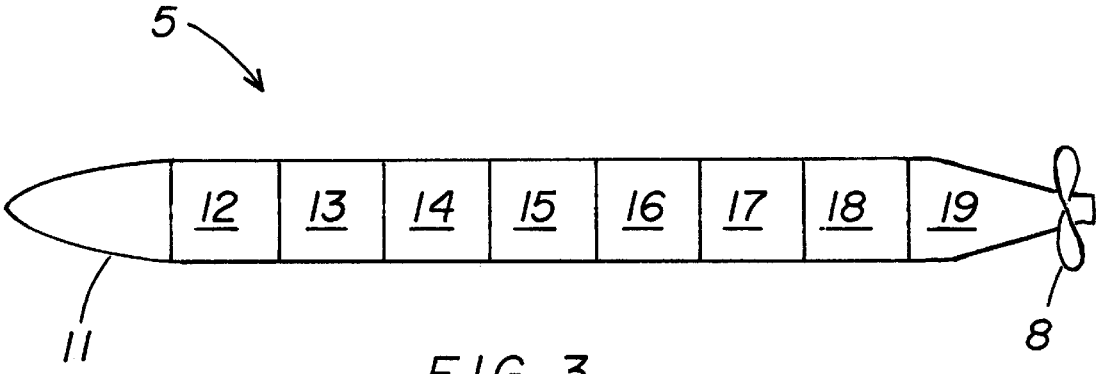
FIG. 3 is a longitudinal sectional view through a hull constituting part of the underwater unit of the watercraft of FIG. 1.

Turning to FIG. 3, each of the hulls 5 has a forward section 11 which can contain a floatable mass, e.g., a body of foamed elastomeric material. The forward section 11 tapers down in a direction from aft to fore. Behind the forward section 11 is a series of chambers 12, 13, 14, 15, 16, 17, 18 and 19. The chambers 12, 14 and 16 are ballast chambers which constitute a means for adjusting the buoyancy so that it is equal to or greater than the gross weight of the watercraft 1. The ballast chambers 12,14,16 permit precise attitude adjustments of the underwater unit 3 for up-and-down movement of the watercraft 1 and can be equipped with non-illustrated pumps for the admission and discharge of ballast water. Alternatively, a compressed air system can be used to discharge ballast water from the ballast chambers 12,14,16. The ballast chambers 12,14,16 also have non-illustrated metering elements to measure the quantities of ballast water passing into and out of the ballast chambers 12,14,16. The ballast chambers 12,14,16 and control surfaces 7 can be operated independently of or in conjunction with one another to accomplish depth adjustment.

Figure 4:
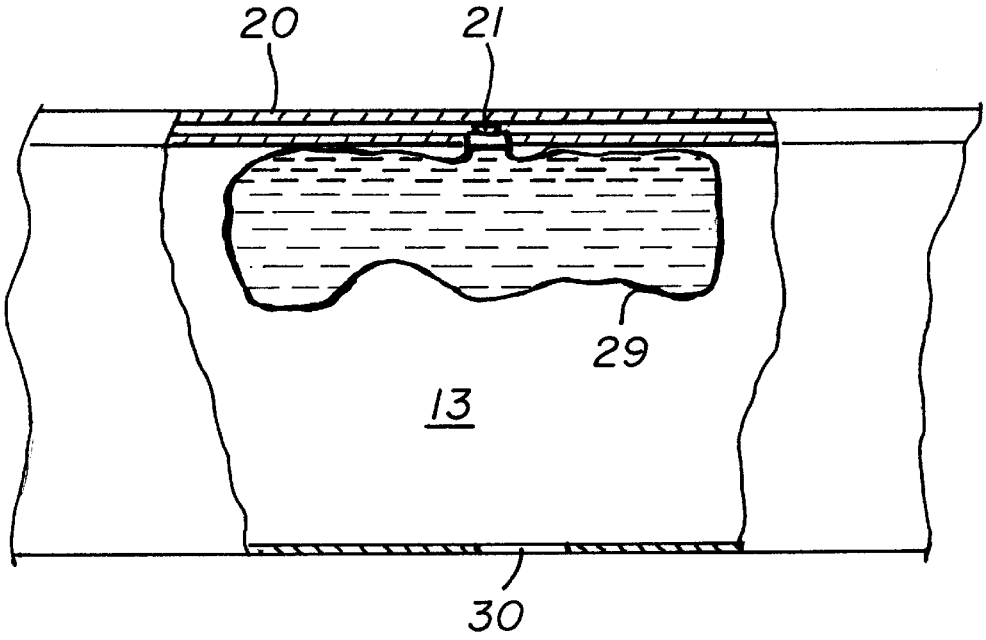
FIG. 4 is a fragmentary longitudinal sectional view of the hull of FIG. 3 showing details of a fuel chamber forming part of the hull.

The chambers 13 and 15 are fuel chambers which can accommodate conventional fuel tanks. As shown in FIG. 4, the fuel chambers 13,15 can, instead, accommodate bladders 29 for the fuel. If the bladders 29 are used, the bottoms of the fuel chambers 13,15 are provided with openings 30 which establish communication between the body of water W and the interiors of the fuel chambers 13,15. The bladders 29 are then exposed to the hydrostatic pressure of the body of water W which assists in expelling the fuel from the bladders 29.

The chamber 17 is an optional water storage chamber. The chamber 17 can accommodate a supply of fresh water or can serve as a holding tank for raw water which is drawn from the body of water W to be subsequently purified and, if necessary, desalinated.

The chamber 18 houses machinery and navigational equipment while the chamber 19 houses an engine for the propeller 8 as well as instrumentation for measuring fuel flow. Examples of machinery and equipment which can be disposed in the chamber 18 are generators, ballasting compressors, fuel transfer pumps and depth sensors.

Figure 5:
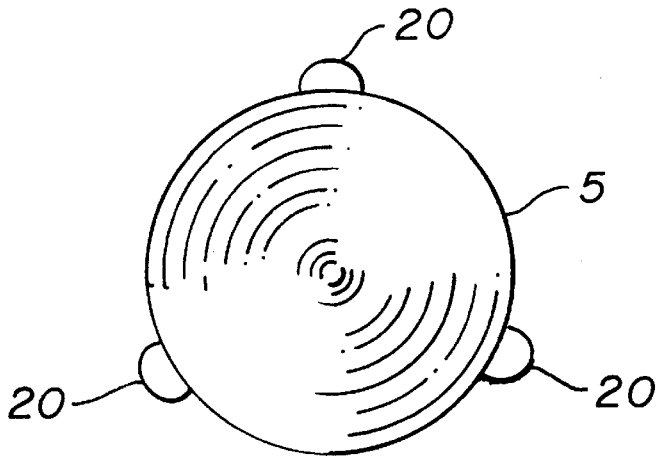
FIG. 5 is a front view of the hull of FIG. 3.

With reference to FIG. 5, each of the hulls 5 is formed with a hollow upper stiffening rib 20 and a pair of hollow lower stiffening ribs 20. The stiffening ribs 20 are elongated and extend longitudinally of the respective hull 5 over the greater part of the length of the hull 5.

The upper stiffening rib 20 of each hull 5 defines a fuel line or conduit and connects the fuel chambers 13,15 with the chamber 19 housing the engine for the respective hull 5. As illustrated in FIG. 4, the bladders 29 of the fuel chambers 13,15 are connected to the interiors of the upper stiffening ribs 20 by remotely operable valves 21. The upper stiffening ribs 20 can carry hydraulic control lines and appropriately sheathed wires for operating the valves 21. The valves 21 make it possible to individually control fuel consumption from the fuel chambers 13,15.

The lower stiffening ribs 20 can carry freshwater piping and, where compressed air is used for ballasting, piping for the compressed air. The lower stiffening ribs 20 can further carry cables and wires for the pumps and sensors in the chambers 12–16 as well as hydraulic lines for hydraulic actuators, etc.

Figure 6:
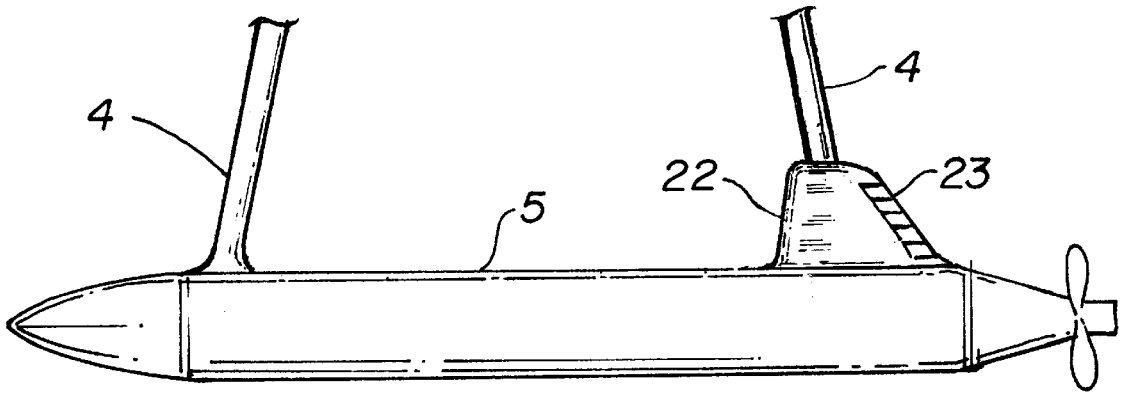
FIG. 6 is a fragmentary side view illustrating certain details of the watercraft of FIG. 1.

The lower portions of the struts 4 will normally be disposed in the vicinity of the surface S of the body of water W. In order to protect the lower portions of the struts 4 against collisions with objects floating at or near the surface S, the lower portion of each strut 4 is encased in an armored housing or sheath 22 shown in FIG. 6. The housings 22 are provided with tabs 23 which function to turn the watercraft 1.

The abovewater unit 2 of the watercraft 1 houses the crew as well as passengers and/or cargo. The abovewater unit 2 additionally houses a control center for navigating the watercraft 1.

Figure 7:
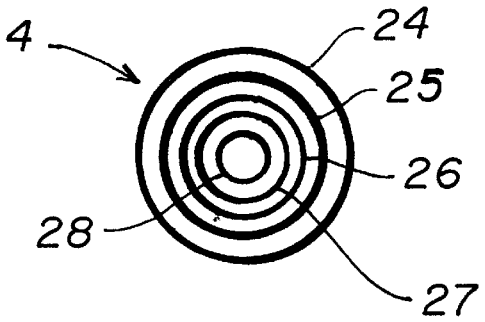
FIG. 7 is a schematic cross-sectional view of one of the struts of the watercraft of FIG. 1.

In accordance with the invention, the struts 4 connecting the abovewater unit 2 and the underwater unit 3 to one another are telescoping. To this end, each of the struts 4 includes a cylinder-and-piston unit containing a single hydraulic cylinder or, as illustrated in FIG. 7, a set of nested hydraulic cylinders 24, 25, 26 and 27. By extending and retracting the cylinders 24,25, 26,27, the abovewater unit 2 and underwater unit 3 may be moved away from and towards one another. The struts 4 can be set at different lengths depending on water conditions. Thus, when sea conditions begin to increase, the struts 4 can be extended to raise the abovewater unit 2 so that this remains above the waves. On the other hand, the struts 4 can be retracted in calm conditions to position the abovewater unit 2 near the surface S of the body of water W.

Inside the innermost cylinder 27 of each strut 4 is a telescoping pipe 28 comprising a plurality of thin-walled plastic cylinders. The pipes 28 are arranged to telescope together with the cylinders 24,25,26,27. The pipe 28 in one of the struts 4 can constitute a duct for delivering air to the underwater unit 3. The air can then be distributed to the engines for the propellers 8 and, if compressed air is used for ballasting, to the ballasting compressors.

The pipe 28 in another of the struts 4 can constitute a means for transferring water from the water storage chambers 17 to the abovewater unit 2. In the event that the water in the water storage chambers 17 is raw water from the body of water W, the abovewater unit 2 can be equipped with desalinating and purifying equipment for the water.

Alternatively, such desalinating and purifying equipment can be installed in the machinery and equipment chambers 18.

The pipe 28 in the third of the struts 4 can house a conductor for fiber optic digital data and command instructions, and cables for transferring signals and electrical power between the underwater unit 3 and the abovewater unit 2.

The telescoping pipes 28 can be replaced by bellows.

As mentioned earlier, the bracing elements 6 are hollow. This allows the bracing elements 6 to carry piping as well as wiring and cables.

The control center of the abovewater unit 2 is preferably equipped with a microprocessor which, in response to signals generated by the sensors in the underwater unit 3, automatically adjusts ballast, and hence the depth of the underwater unit 3. During travel, the underwater unit 3 will normally be positioned at a depth such that the underwater unit 3 is unaffected, or virtually unaffected, by conditions at the surface S of the body of water W.

The watercraft 1 makes it possible to combine the fuel and operating economies, as well as the propulsion efficiency, of a submersible watercraft with the passenger- and cargo-carrying capability of a surface watercraft. Moreover, inasmuch as the strength requirements of the watercraft 1 are far less than those of a surface watercraft, and inasmuch as the underwater unit 3 need not be designed for human habitation, the structural requirements are moderate and the watercraft 1 can be manufactured relatively inexpensively. Consequently, the watercraft 1 is able to economically transport passengers and cargo at speeds greatly exceeding those achievable today. The speed and economy of the watercraft 1 can be enhanced by shaping the abovewater unit 2 and the underwater unit 3 aerodynamically. Furthermore, since the underwater unit 3 can be constructed so as to provide a stable support structure for the abovewater 2 and the latter can be raised above wave level, the watercraft 1 can provide seafarers with a degree of stability, comfort and silence unknown until now.

The watercraft 1 has both military and civilian applications. From a military viewpoint, the watercraft 1 is, or can be designed to be, invisible to radar. Examples of military uses are as a helicopter platform, a radar platform, a weapons platform and a troop carrier. Civilian applications for the watercraft 1 include its use as a private yacht, a rescue vessel, a passenger vessel and a cargo vessel.

Various modifications can be made within the meaning and range of equivalence of the appended claims.

I claim:

1. A watercraft, comprising an abovewater transport unit; an underwater unit for supporting said abovewater unit; and means for moving said units towards and away from one another, said underwater unit including a pair of spaced hulls, and bracing means rigidly joining said hulls to one another, and said moving means comprising three telescoping elements which are inclined so that said telescoping elements and said abovewater unit resemble a tripod.

2. The watercraft of claim 1, wherein said underwater unit comprises a propulsion element.

3. The watercraft of claim 2, wherein said underwater unit is provided with a fuel chamber for said propulsion element.

4. The watercraft of claim 3, wherein said underwater unit is provided with a ballast chamber.

5. The watercraft of claim 4, wherein said underwater unit is provided with a plurality of fuel chambers and a plurality of ballast chambers, said fuel chambers alternating with said ballast chambers.

6. The watercraft of claim 1, wherein two of said telescoping elements extend between said abovewater unit and respective ones of said hulls, the third of said telescoping elements extending between said abovewater unit and said bracing means.

7. The watercraft of claim 3, wherein said fuel chamber comprises a bladder.

8. The watercraft of claim 1, wherein said underwater unit is provided with a ballast chamber.

9. The watercraft of claim 1, wherein said underwater unit comprises directional control means.

10. The watercraft of claim 1, wherein said underwater unit is elongated and has an external peripheral surface, said underwater unit including at least one longitudinally extends stiffening element on said surface.

11. The watercraft of claim 10, wherein said one stiffening element is hollow, said underwater unit including a pipe in said one stiffening element.

12. The watercraft of claim 1, wherein said moving means has a lower portion arranged to be located in the region of an air-water interface and said underwater unit comprises means for shielding said lower portion against collisions with floating objects.

13. The watercraft of claim 1, wherein said underwater unit comprises propulsion means and said abovewater unit comprises control means for said propulsion means.

14. The watercraft of claim 1, wherein said underwater unit comprises ballast means and said abovewater unit comprises control means for said ballast means.

15. The watercraft of claim 1, wherein said moving means is designed to move said units towards and away from one another essentially linearly.

16. A watercraft, comprising an abovewater transport unit; an underwater unit for supporting said abovewater unit; and means for moving said units towards and away from one another, said underwater unit comprising a propulsion element, a plurality of fuel chambers including a fuel chamber for said propulsion element, a plurality of ballast chambers, a fuel conduit which extends along said chambers, and valve means for selectively connecting each of said fuel chambers with said conduit, said fuel chambers alternating with said ballast chambers.

17. A watercraft, comprising an abovewater transport unit; an underwater unit for supporting said abovewater unit; and means for moving said units towards and away from one another, said underwater unit including a pair of spaced hulls, bracing means rigidly joining said hulls to one another, and control surfaces movably mounted on said bracing means for providing vertical stability by the exertion of forces at least equalling the buoyancy of said units.

18. A watercraft, comprising an abovewater transport unit; an underwater unit for supporting said abovewater unit; and means for moving said units towards and away from one another, said underwater unit being elongated and having an external peripheral surface, and said underwater unit including a propulsion element, and at least one longitudinally extending stiffening element on said surface, said one stiffening element being hollow and constituting a fuel conduit for said propulsion element.

19. A watercraft, comprising an abovewater transport unit; an underwater unit for supporting said abovewater unit; means for moving said units towards and away from one another; and means for transmitting control signals between said units, said transmitting means extending through said moving means.

20. A watercraft, comprising an abovewater transport unit; an underwater unit for supporting said abovewater unit; and means for moving said units towards and away from one another, said moving means including conduit means for conveying water between said units.

21. A watercraft, comprising an abovewater transport unit; an underwater unit for supporting said abovewater unit; means for moving said units towards and away from one another; and means for transmitting electrical power between said units, said transmitting means extending through said moving means.

22. The watercraft of claim 21, wherein said underwater unit comprises a torpedo-like hull.

23. The watercraft of claim 21, wherein said underwater unit comprises a pair of spaced hulls.

24. The watercraft of claim 23, wherein said underwater unit comprises bracing means rigidly joining said hulls to one another.

25. The watercraft of claim 21, wherein said moving means comprises at least one telescoping element.

26. The watercraft of claim 25, wherein said moving means comprises a plurality of telescoping strut-like elements.

27. A watercraft, comprising an abovewater transport unit; an underwater unit for supporting said abovewater unit; and means for moving said units towards and away from one another, said moving means including conduit means for conveying air between said units.

28. A method of operating a watercraft, comprising the steps of maintaining one part of said watercraft above the surface of a body of water and another part of said watercraft, which supports said one part, below said surface; and moving said parts towards or away from each other.

29. The method of claim 28, wherein the maintaining step comprises positioning said one part at a height exceeding wave height, and positioning said other part at a depth such that said other part is essentially unaffected by conditions at said surface.

30. The method of claim 28, wherein the moving step comprises raising said one part as wave height increases.

31. The method of claim 28, wherein the moving step is performed essentially linearly.

* * * * *